US005892443A

United States Patent [19]

Friedrich

[11] Patent Number: 5,892,443

[45] Date of Patent: Apr. 6, 1999

[54] VEHICLE DOOR LOCK WITH A LATCH SYSTEM AND A LOCKING SYSTEM AND ELECTRONIC CONTROL

[75] Inventor: Hagen Friedrich, Essen, Germany

[73] Assignee: Kiekert AG, Heiligenhaus, Germany

[21] Appl. No.: 993,852

[22] Filed: Dec. 18, 1997

[30] Foreign Application Priority Data

Jan. 25, 1997 [DE] Germany ..... 197 02 689.3

[51] Int. Cl.[6] ..... G08B 21/00

[52] U.S. Cl. ..... 340/540; 70/276; 324/202

[58] Field of Search ..... 340/540, 511, 340/542, 679, 686, 438; 70/276; 324/202

[56] References Cited

U.S. PATENT DOCUMENTS 5,032,791 7/1991 Bates, Jr. ..... 324/202

FOREIGN PATENT DOCUMENTS 0 694 665 1/1996 Germany .
296 18 688 1/1997 Germany .

*Primary Examiner*—Thomas J. Mullen, Jr.
*Attorney, Agent, or Firm*—Herbert Dubno

[57] ABSTRACT

A vehicle door lock apparatus utilizes Hall-effect sensors for the position of an element in a latch or locking system and, according to the invention, the Hall-effect sensor chip or the evaluating circuitry enables the generation of first control signals when the first information signal current amplitude is above an upper threshold, the generation of second control signals with a second information signal below the upper threshold is above a lower threshold and an alarm signal when the information signal is between the lower threshold and zero. In this manner defects in the Hall-effect sensor, the conductive path between the Hall-effect sensor and the evaluating circuitry and in the current supply to the Hall-effect sensor can be detected simply and economically.

5 Claims, 2 Drawing Sheets

VEHICLE DOOR LOCK WITH A LATCH SYSTEM AND A LOCKING SYSTEM AND ELECTRONIC CONTROL

FIELD OF THE INVENTION

My present invention relates to a vehicle door lock with a latch system and a lock system which can operate upon the latch system or the vehicle locks and having electronic control capable of detecting positions of elements of the bolt and/or lock systems and which may utilize as position detectors Hall-effect sensor chips with magnetic actuation and chip circuitry outputting currents providing the information signals from the Hall-effect sensor and which are fed to an evaluating or control circuit operating the aforementioned systems and the locks.

BACKGROUND OF THE INVENTION

Hall-effect sensor chips can generate different information signals which are transformed by the electronic circuitry connected thereto to different control signals. The control signals, in turn, can, in a vehicle door lock system, bring about the different functions of the latch or bolt system and the locking system, usually via motors or other drivers or effectors which displace the elements, for example, levers of the door locks and/or energize control lamps or other signalling devices.

For example, one effector or motor can operate the bolt mechanism of a door lock for latching and unlatching that door lock, of a central locking system for the vehicle as a whole. In this arrangement and in the preferred embodiment of the invention, two Hall-sensor chips can co-act as part of the control system to signal the position or status of the lock or lock element.

When reference is made here to a latching or bolt system, we mean to describe the type of central locking system for a vehicle in which an effector can rotate the bolt of the lock into and out of engagement with the pin on the door post and can operate the usual keeper for the rotary bolt. When we refer to the lock system for this arrangement, we mean to include at least one mechanical lock cylinder which can be rotated by a mechanical key and which normally has three functional positions, namely, an intermediate starting position, a latching and unlatching position to one side of the intermediate position and in which the bolt can be operated in the manner described, and an antitheft position to the opposite side of the intermediate position and in which, upon rotation of the cylinder into this position, the door locks can be secured in an antitheft arrangement. In this position, operation of the door locks is blocked.

The locking cylinder can cooperate with the control circuitry of the vehicle door lock system which can also receive inputs or can interrogate the door locks as to current status of the positions of elements thereof or can interrogate the cylinder as to its position. To this end, the position detectors can be Hall-effect sensor chips in the manner described or the Hall-effect sensor chips can be positioned to detect the selected positions of the lock cylinder.

For example, the lock cylinders can have two fixed Hall-effect sensor chips each with a respective Hall-effect sensor and chip circuit, and a ferromagnetic element which is operatively connected or forms part of the lock cylinder and which can detect the position of the lock cylinder. The lock cylinder can have an intermediate zero position. Generally speaking the Hall-effect sensor chips or the circuitry therefor can have a lower current threshold and an upper current threshold.

Door locks of this type are described, for example, in DE 196 34 321, corresponding to U.S. application Ser. No. 08/915,897 filed 21 Aug. 1997 by Hagen FRIEDRICH, Andreas SIEKIERKA and Thorsten TORKOWSKI, and DE 296 18 688 U1, corresponding to U.S. application Ser. No. 08/950,792 filed 16 Oct. 1997 by Peter BARTEL, Johannes-Theodor MENKE and Thorsten TORKOWSKI. Reference may also be made to EP 0 694 665 A1.

The described door locks utilize Hall-effect sensor chips which can generate first information signals of a high current level $I_{high}$ and second information signals at a lower current amplitude $I_{low}$. However, defects in Hall-effect sensor chips, in the conductive path or circuitry between a Hall-effect sensor chip and the evaluating circuitry, or in the current supply of a Hall-effect sensor chip can arise and can interfere with the operation of such systems.

OBJECTS OF THE INVENTION

It is, therefore, an object of the present invention to provide a vehicle door lock apparatus which is free from such drawbacks and in particular can, with little additional cost or complications, signal defects in the Hall-sensor chip or chips, defects in the conductive path or circuitry between the Hall-effect sensor chips or chips and the evaluating electronics or in the current supply to the Hall-effect sensor chip or chips.

It is another object of the invention to provide an improved vehicle door lock system utilizing Hall-effect position detectors whereby disadvantages of earlier systems are avoided.

SUMMARY OF THE INVENTION

Essentially these objects are achieved, in accordance with the invention in a vehicle door lock apparatus wherein vehicle door locks are operated by an electronically controlled latch system for bolting and unbolting of the vehicle door locks or by an electronically controlled lock system for blocking of the door locks and wherein at least one magnetically actuated Hall-effect sensor chip with a chip circuit is provided for signalling a position of at least one of the systems.

According to the invention, this arrangement or apparatus can comprise:

means for deriving from the Hall-effect sensor chip a first information signal at a relatively high current amplitude $I_{high}$ and a second information signal with a relatively low current amplitude $I_{low}$ above a zero level;

control means connected to the means for deriving and receiving the first and second information signals for:

processing the first information signal to first control signals upon the relatively high current amplitude $I_{high}$ lying above an upper current threshold $I_{SO}$ above the relatively low current amplitude $I_{low}$, establishing a lower current threshold $I_{SU}$ above the zero level and below the relatively low current amplitude $I_{low}$, processing the second information signal to second control signals upon the relatively low current amplitude $I_{low}$ lying above the lower current threshold $I_{SU}$, and processing a third information signal outputted by the Hall-effect sensor chip and lying between the lower current threshold $I_{SU}$ and the zero level into a third control signal, the at least one of the systems being operated by the first and second control signals; and an alarm connected to the control means and operated by the third control signal for alerting a vehicle operator to a defect in the Hall-effect sensor chip, a defect in circuitry between the Hall-effect sensor chip and the control means or a defect in current supply to the Hall-effect sensor chip.

In method terms, the invention comprises the steps of:

(a) means for deriving from the Hall-effect sensor chip a first information signal at a relatively high current amplitude $I_{high}$ and a second information signal with a relatively low current amplitude $I_{low}$ above a zero level;

(b) processing the first information signal to first control signals upon the relatively high current amplitude $I_{high}$ lying above an upper current threshold $I_{SO}$ above the relatively low current amplitude $I_{low}$;

(c) establishing a lower current threshold $I_{SU}$ above the zero level and below the relatively low current amplitude $I_{low}$, (d) processing the second information signal to second control signals upon the relatively low current amplitude $I_{low}$ lying above the lower current threshold $I_{SU}$, (e) processing a third information signal outputted by the Hall-effect sensor chip and lying between the lower current threshold $I_{SU}$ and the zero level into a third control signal, the at least one of the systems being operated by the first and second control signals; and (f) operating an alarm with the third control signal for alerting a vehicle operator to a defect in the Hall-effect sensor chip, a defect in circuitry between the Hall-effect sensor chip and the control means or a defect in current supply to the Hall-effect sensor chip.

The invention operates, in its broadest terms, with a vehicle door lock apparatus having both a latching or bolt system and a lock system operating upon that latching or bolt system, with an electronic control and/or operating system interrogating positions of components of the lock system and/or the bolt or latch system and in which at least one electrically-energized Hall-effect sensor chip has a magnetic actuator and chip electronics feeding the evaluation circuitry of the control and/or operating system.

The described operations can be carried out largely by programming the evaluation circuitry or otherwise providing the circuitry available in a central lock system with the threshold and/or converters which transform the current levels into digital signals which can be compared with the thresholds and can output the various control signals which are necessary.

According to a feature of the invention, two Hall-effect sensor chips are used and the evaluating electronics transforms the information signals into the control signals when the first information signal is outputted by both Hall-effect sensor chips. The circuitry can also generate the second information signal when a first information signal is generated by one of the Hall-effect sensor chips simultaneously with the generation by the other Hall-effect sensor chip of a second information signal which exceeds the lower current threshold. The alarm is triggered when the circuitry receives from one of the Hall-effect sensor chips a current level between zero and the lower threshold, i.e. when a defect arises in one of the Hall sensor chips and/or in the conductive path between that chip and the evaluating circuitry or in the current supply to that Hall sensor chip.

It will be understood that the term "alarm" is used here to refer to an optical alarm, e.g. the illumination of a signal lamp or the like, or to an acoustic alarm capable of generating a sound, or both.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
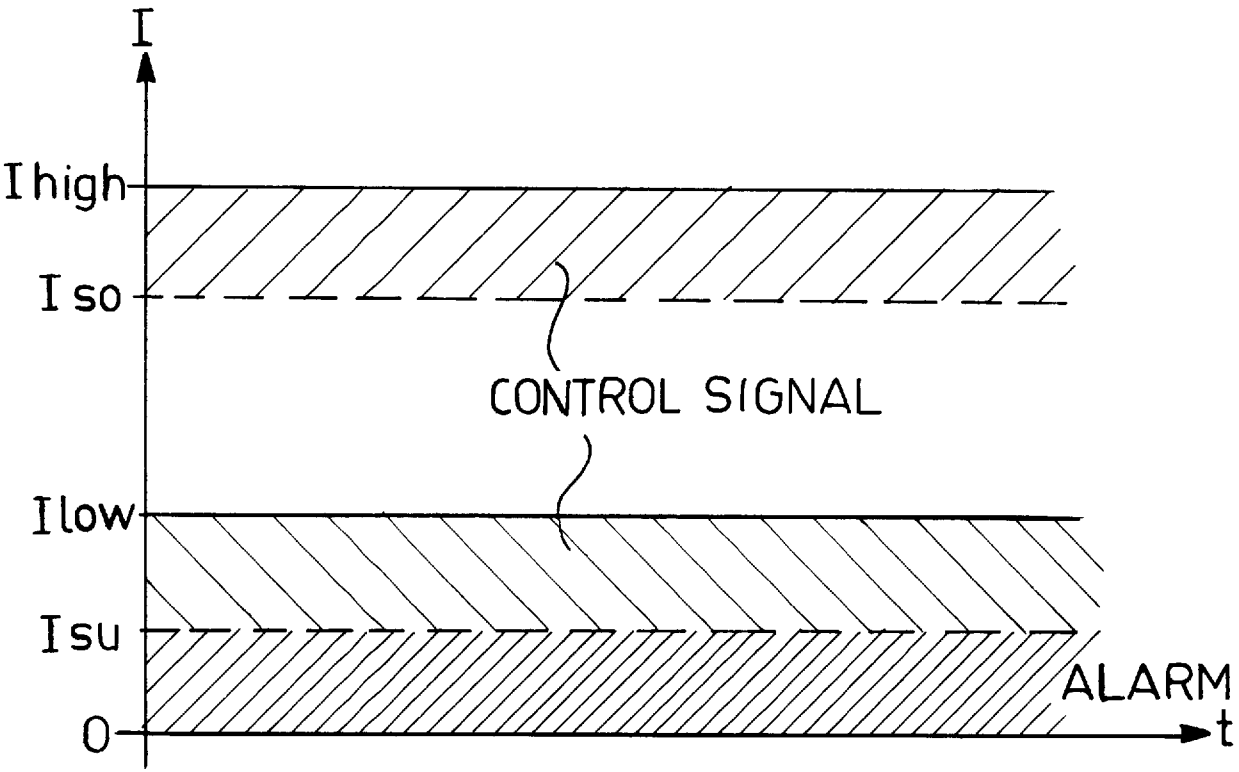
FIG. 1 is a diagram illustrating the information signals with the current amplitude plotted along the ordinate versus time along the abscissa.

In the diagram of FIG. 1, the current amplitude has been plotted along the ordinate and time along the abscissa for a plot in which the information signals with their current levels $I_{high}$ and $I_{low}$ are given with respect to the thresholds $I_{SO}$ and $I_{SU}$, respectively. These information signals are generated by a Hall-effect sensor chip in the lock system of FIG. 2. The evaluating circuitry can process the information signals to control signals and in the hatched portion of the plot, between the lines representing the upper current threshold $I_{SO}$ and the first information signal $I_{high}$, the first control signals are generated. These control signals can be used to operate the latch system or to illuminate a control lamp or the like.

The generation of a low current information signal $I_{low}$ which is above the lower threshold $I_{SU}$, in the hatched region, results in processing those signals to the second control signals which can operate a control lamp or the like system. Between the lines representing the threshold $I_{SO}$ and the second information signal $I_{low}$, is a significant differentiation, thereby providing a sharp differentiation between the control signals in the two widely hatched regions. In the closely hatched region between the zero level and the lower threshold $I_{SU}$, an alarm is triggered which indicates a defect in the Hall-sensor chip and/or in the conductive path between the Hall sensor chip and the evaluating electronics or in the current supply to the Hall sensor chip.

Figure 2:
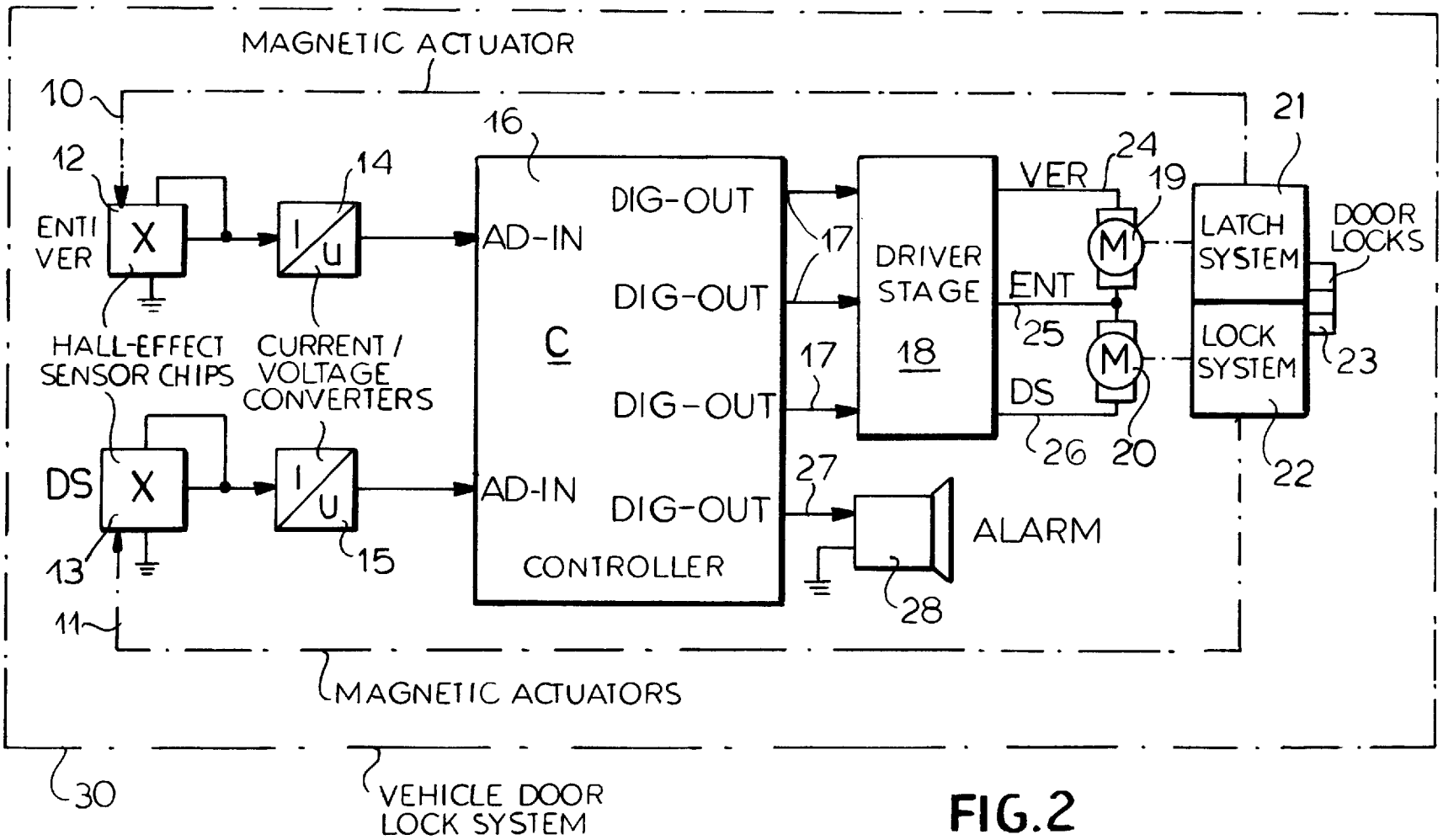
FIG. 2 is a block diagram of a door lock apparatus according to the invention.

It is also possible to limit the levels of the information signals $I_{low}$ and $I_{high}$ in terms of current amplitude so that additional upper thresholds for each will not be necessary. The block diagram of FIG. 2 shows two Hall sensor chips X and respective magnetic actuators 10 and 11 which can be connected to movable parts of the lock system such as the key-operated cylinder and/or other positionable elements thereof. From the two Hall sensor chips 12 and 13, current signals can be applied to current/voltage converters 14, 15 which feed the electronic controller here represented at 16 and which can be a programmable, processor-based microcomputer. The digital outputs of the controller as represented at 17 can be applied to a driver stage 18 containing the electrical drivers for the effectors 19 and 20, here electric motors which are coupled, say to the latch system and the rotary bolt as represented at 21 and to the lock system 22, effecting antitheft blocking of the latch system.

A set of door locks is represented at 23 and can be operated by the latch and locking systems and the control signals along lines 24 and 25 can serve to supply the latching and unlatching signals to the effectors while the antitheft control signal is applied at line 26. The functions locking and unlocking are represented at VER and ENT, respectively, while the antitheft position is represented at DS. A further control signal is outputted at 27 by the controller 16 to the audio or visible alarm 28. The controller 16 is, as has been noted, software-controllable.

The vehicle door lock apparatus as a whole is represented at 30 in the drawing.

The Hall-effect sensor chip can comprise a conventional Hall plate, preferably composed of an appropriate semiconductor material, potted in a synthetic resin with an integrated circuit as is conventional for such Hall-effect detectors including, for example, an amplifier, a semiconductor switch and a comparator. The Hall effect is well known and its use in position detection circuitry is also well known. The threshold circuitry can be in the chip itself or in the evaluating electronics for the chip.

I claim:

1. In a vehicle door lock apparatus wherein vehicle door locks are operated by an electronically controlled latch system for bolting and unbolting of the vehicle door locks or by an electronically controlled lock system for blocking of said door locks and wherein at least one magnetically actuated Hall-effect sensor chip with a chip circuit is provided for signalling a position of at least one of said systems, the improvement which comprises:

means for deriving from said Hall-effect sensor chip a first information signal at a relatively high current amplitude $I_{high}$ and a second information signal with a relatively low current amplitude $I_{low}$ above a zero level;

control means connected to said means for deriving and receiving said first and second information signals for:

processing said first information signal to first control signals upon said relatively high current amplitude $I_{high}$ lying above an upper current threshold $I_{SO}$ above said relatively low current amplitude $I_{low}$, establishing a lower current threshold $I_{SU}$ above said zero level and below said relatively low current amplitude $I_{low}$, processing said second information signal to second control signals upon said relatively low current amplitude $I_{low}$ lying above said lower current threshold $I_{SU}$, and processing a third information signal outputted by said Hall-effect sensor chip and lying between said lower current threshold $I_{SU}$ and said zero level into a third control signal, said at least one of said systems being operated by said first and second control signals; and an alarm connected to said control means and operated by said third control signal for alerting a vehicle operator to a defect in said Hall-effect sensor chip, a defect in circuitry between said Hall-effect sensor chip and said control means or a defect in current supply to said Hall-effect sensor chip.

2. The improvement defined in claim 1 wherein said thresholds are established in the chip electronics.

3. The improvement defined in claim 1 wherein said thresholds are established by electronic circuitry connected to said chips and evaluating signals outputted by said chips.

4. The improvement defined in claim 1 wherein two co-acting Hall-effect sensor chips are provided for signalling said position and said control means processes information signals to said first control signal when both Hall-effect sensor chips output said first information signal and to said second control signals when one of said Hall-effect sensor chips outputs a second information signal above said lower current threshold and the other of said Hall-effect sensor chips outputs a first information signal with said high current amplitude $I_{high}$, said alarm being triggered when at least one of the Hall-effect sensor chips outputs said third information signal lying between said lower current threshold $I_{SU}$ and said zero level.

5. A method of operating a vehicle door lock apparatus in a vehicle door lock apparatus wherein vehicle door locks are operated by an electronically controlled latch system for bolting and unbolting of the vehicle door locks or by an electronically controlled lock system for blocking of said door locks and wherein at least one magnetically actuated Hall-effect sensor chip with a chip circuit is provided for signalling a position of at least one of said systems, said method comprising the steps of:

(a) deriving from said Hall-effect sensor chip a first information signal at a relatively high current amplitude $I_{high}$ and a second information signal with a relatively low current amplitude $I_{low}$ above a zero level;

(b) processing said first information signal to first control signals upon said relatively high current amplitude $I_{high}$ lying above an upper current threshold $I_{SO}$ above said relatively low current amplitude $I_{low}$;

(c) establishing a lower current threshold $I_{SU}$ above said zero level and below said relatively low current amplitude $I_{low}$, (d) processing said second information signal to second control signals upon said relatively low current amplitude $I_{low}$ lying above said lower current threshold $I_{SU}$, (e) processing a third information signal outputted by said Hall-effect sensor chip and lying between said lower current threshold $I_{SU}$ and said zero level into a third control signal, said at least one of said systems being operated by said first and second control signals; and (f) operating an alarm with said third control signal for alerting a vehicle operator to a defect in said Hall-effect sensor chip, a defect in circuitry between said Hall-effect sensor chip and said control means or a defect in current supply to said Hall-effect sensor chip.

* * * * *